United States Patent [19]

Janczak

[11] Patent Number: 4,548,557

[45] Date of Patent: Oct. 22, 1985

[54] HYDRAULIC PUMP OR MOTOR WITH INTERCHANGEABLE GEARS

[76] Inventor: Jerzy Janczak, S:t Mickelsgatan 71, S-126 54 Hägersten, Sweden

[21] Appl. No.: 504,992

[22] Filed: Jun. 16, 1983

[30] Foreign Application Priority Data

Jun. 23, 1982 [SE] Sweden ..... 8203923

[51] Int. Cl.[4] ..... F04C 2/00

[52] U.S. Cl. ..... 418/76; 41/96; 41/206

[58] Field of Search ..... 418/71-74, 418/131-135, 15, 2, 196, 197, 206, 39, 96

[56] References Cited

U.S. PATENT DOCUMENTS

| | | | |
|---|---|---|---|
| 2,589,528 | 3/1952 | Bergsma | 418/196 |
| 2,824,524 | 2/1958 | Banker | 418/133 |
| 3,545,898 | 12/1970 | Bobst | 418/39 |
| 4,065,235 | 12/1977 | Furlong | 418/206 |

FOREIGN PATENT DOCUMENTS

| | | | |
|---|---|---|---|
| 2260010 | 6/1973 | Fed. Rep. of Germany . | |
| 742876 | 3/1933 | France | 418/96 |
| 347794 | 8/1972 | Switzerland . | |
| 1147781 | 4/1969 | United Kingdom . | |

*Primary Examiner*—Leonard E. Smith
*Assistant Examiner*—Jane E. Obee
*Attorney, Agent, or Firm*—Sughrue, Mion, Zinn, Macpeak and Seas

[57] ABSTRACT

A hydraulic pump motor components including at least two co-acting gears arranged in wells which conform to the gears and which communicate with channels for supply and return oil respectively. To enable the displacement of the pump or motor to be readily changed, the housing of the pump or motor is made in two parts (1, 2) which can be sealingly coupled together. The one part (1), the mounting part, in which the input shaft (3) of the pump, or the output shaft (3) of the motor, is journalled is provided with an inlet and an outlet (10, 11) for supply and return oil respectively. The shaft (3) passes completely through the mounting part (1) and projects from the end surface of the mounting part located in the dividing plane of the housing, for receiving a sun wheel (5). The journal shafts (8, 9) for the planet wheels (6, 7) also project out from the end surface, and channels for supply and return oil respectively discharge into this end surface. The other part of the housing is a readily exchangeable cover (2) which serves as a pressure chamber and which is provided with wells (16) for the planet wheels (5, 6, 7). The cover (2) is also provided with bores (17, 18, 19, 20) which extend from the surface of the cover located in the dividing plane of the housing and which communicate with the aforementioned wells. These bores are arranged, when the cover (2) is mounted onto the mounting part (1) to connect with the mouths (12, 13, 14, 15) of the oil supply and return channels respectively in the end surface of the mounting part.

5 Claims, 5 Drawing Figures

HYDRAULIC PUMP OR MOTOR WITH INTERCHANGEABLE GEARS

TECHNICAL FIELD

The present invention relates to a hydraulic pump or a hydraulic motor of the kind in which the active components of the pump or motor include at least two coacting gears arranged in wells which accurately conform to said gears, said wells communicating with oil-supply channels and oil-return channels respectively and in which the pump housing or motor housing comprises two parts which can be sealingly coupled together.

BACKGROUND ART

Hydraulic pumps or hydraulic motors of this kind are used in many different connections. A common feature with such pumps or motors is, inter alia, that a change in the displacement or transmission ratio between pump and motor requires the exchange of whole units, or in the best of cases a plurality of components, although even this normally requires the pump or motor to be completely dismantled. In this respect, it is also often necessary to disconnect the external hydraulic lines. Another disadvantage with these known pumps and motors is that the hydraulic-oil connections are arranged axially in relation to the pump housing or motor housing, which often causes difficulty in assembly and/or in drawing the hydraulic lines.

OBJECT OF THE INVENTION

The prime object of the invention is to provide a hydraulic pump or a hydraulic motor in which the displacement or transmission ratio between pump and motor can be readily changed, by exchanging a single part and without needing to disconnect the hydraulic lines.

BRIEF SUMMARY OF THE INVENTION

This object is achieved in accordance with the invention in that the one part, the mounting part, in which the input shaft of the pump, or the output shaft of the motor, is journalled, is provided with requisite inlets and outlets for supply and return oil respectively; in that said shaft passes completely through the mounting part and extends from the end surface of said mounting part located in the dividing plane of the housing, for receiving a sun wheel; in that the necessary journal shafts for requisite planet wheels are fixedly mounted to the mounting part and extend from the same end surface; that channels for supply and return oil respectively discharge into said end surface; and in that the other part of said housing has the form of a readily exchangeable cover which serves as a pressure chamber and which has blind wells for accomodating the sun and planet wheels, which are removeably mounted on said shaft and respective journal shafts, said wells communicating with bores which extend from the surface of the cover located in the dividing plane of said housing and which, when said cover is mounted onto the mounting part, are arranged to connect with the mouths of the oil-supply channels and oil-return channels respectively in said end surface of the mounting part.

In order, among other things, to facilitate assembly, the mounting part of the housing is suitably provided with radial inlets and outlets for hydraulic oil.

In a preferred embodiment, the pump, or the motor, includes two planet wheels, and the mounting part is provided with an inlet and an outlet for hydraulic oil, each of which communicates with a respective channel, each of which channels branches and forms two discharge orifices in said end surface of said mounting part, said cover having four ports which communicate with said wells.

In order to enable the displacement of a pump, or motor, according to the invention to be readily changed, by changing the cover and gears, the axially innermost surfaces of respective wells in the cover, when said wells are adapted to gears whose axial length is shorter than the length of the journal shafts protruding from the mounting part, can be provided with coaxial recesses for receiving the additional length of said journal shafts extending beyond the gears.

When the hydraulic pump is to be used as a submersible pump and is used for very high rotary speeds, the cover is suitably provided with at least one port which is capable of being closed by a removeable plug and which can serve as an auxilliary lubricating-orifice, should the oil level fall beneath the main feed orifice. In order to ensure positive lubrication of the shaft passing through the mounting part of said casing, and in order to avoid damage to the seal extending around said shaft, should the seal be subjected to excessive oil pressure, said mounting part is preferably provided with a channel which connects the oil-return channel to the shaft lead-through hole in said mounting part.

The invention will now be described in more detail with reference to the accompanying drawings.

DESCRIPTION OF A PREFERRED EMBODIMENT OF THE INVENTION

Figure 1:
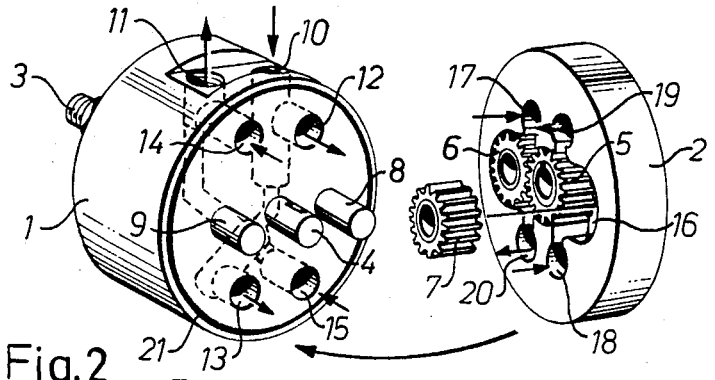
FIG. 1 illustrates the principle construction of a hydraulic pump or hydraulic motor according to the invention.

As will be seen from FIG. 1, the housing of a hydraulic pump, or hydraulic motor, according to the present invention is made in two parts 1 and 2, which can be sealingly coupled together. The housing part 1 is intended to serve as a fixed mounting part, and incorporate the input shaft 3 of the pump, or the output shaft of the motor. The shaft 3 passes completely through the mounting part 1 and extends from the end surface of said mounting part located in the dividing plane of the housing, to form a journal shaft 4. A gear 5 which serves as a sun wheel is mounted on the journal shaft 4 by means of a conventional spline coupling, so as to be non-rotatable relative to said shaft. In the illustrated embodiment, the pump, or motor, includes two planet wheels 6 and 7, which are intended to be mounted on journal shafts 8 and 9 respectively, which also protrude from said end surface of the mounting part 1.

The mounting part 1 is provided with an inlet 10 and an outlet 11 for supply oil and return oil respectively. Extending from the inlet 10 is a channel which branches and discharges into the end surface of the mounting part 1 at locations 12 and 13 respectively. In a corresponding manner, the outlet 11 is connected with ports 14 and 15 in said end surface, via two branch channels.

As will also be seen from FIG. 1, the pressure chamber of the pump, or the motor, has the form of a cover 2 which incorporates wells 16 for receiving respective gears. The wells 16 communicate with blind bores 17 and 18 for supply oil and blind bores 19 and 20 for return oil, said bores extending axially from the surface of said cover located in the dividing plane of said housing.

The cover 2 can be sealingly fastened to the mounting part 1, with the aid of screws or like fasteners, an O-ring 21 of the mounting part serving as a sealing member. When the mounting part 1 is assembled to the cover 2, the ports 12 and 13 will be located opposite the bores 17 and 18, while the ports 14 and 15 will be located opposite the bores 19 and 20.

Figure 2:
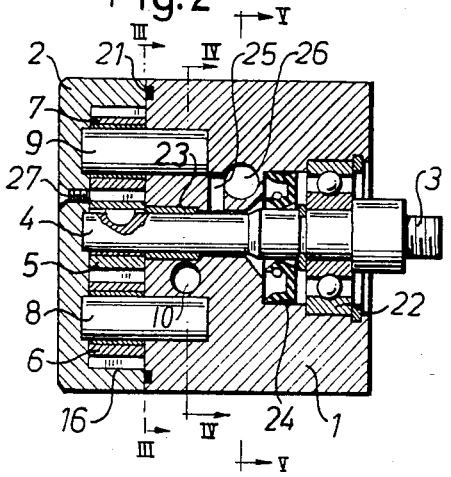
FIG. 2 is a longitudinal sectional view of an arrangement according to the invention.

FIG. 2 is a longitudinal sectional view of a pump, or motor, according to the invention, in which the cover 2 is mounted on the mounting part 1. In order to change the torque ratio or speed ratio of gear pumps or motors it is known to change gears for axially longer or shorter gears, depending upon whether it is desired to decrease or increase displacement. Normally, this would require the exchange of a multiplicity of components, and normally requires the pump, or the motor, to be completely dismantled and the supply and return lines disconnected therefrom. When making a corresponding exchange in a pump or motor constructed in accordance with the present invention, it is only necessary to replace the cover 2 and associated gears with a corresponding unit having different axial gear lengths and correspondingly different axial well depths, as will be seen from FIG. 1. Consequently, the mounting part 1 may be permanently mounted to a drive means or a driven means, and connected thereto via the shaft 3, and the hydraulic lines need not be loosened or disconnected. In this respect, the journal shafts 4, 8 and 9, which also belong to the mounting part 1, may have a length which permits them to be used for gears of varying axial length. When used together with gears whose breadth is shorter than the length of the journal shafts, the cover 2 is provided with coaxial recesses in the axially innermost surfaces of respective wells, for accommodating this additional length of the shaft beyond the gears. One such embodiment is illustrated in FIG. 2.

FIG. 2 also shows that the shaft 3 is journalled in the mounting part 1 by means of ball bearings 22 and a plain bearing 23. In order to ensure that the shaft is properly lubricated, and in order to enable a low-pressure seal 24 to be used, the lead-through hole for the shaft 3 in the mounting part 1 communicates, via a channel 25, with a return channel 26 conducting oil to the outlet 11. This guarantees that the seal 24 cannot be destroyed by high-pressure oil being pressed along the shaft, since such oil is effectively drained through the return channel. In addition to simplifying the construction and rendering said construction less expensive, it also reduces the risk of oil spillage.

Figure 3:
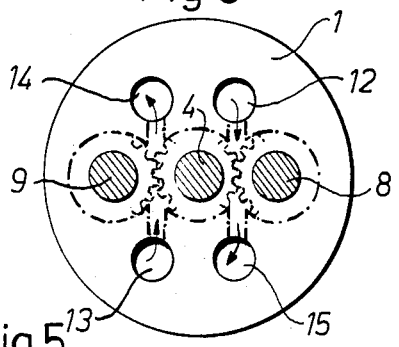
FIG. 3 is an end view taken in the direction of the arrows III—III in FIG. 2, and illustrates the positions of the gear wheels in relation to the mouths of the oil channels.

FIG. 3 illustrates more clearly how the supply and return ports for oil are placed in the end surface of the mounting part 1 in relation to the gears 5–7 and corresponding wells 16 in the cover 2.

Figure 5:
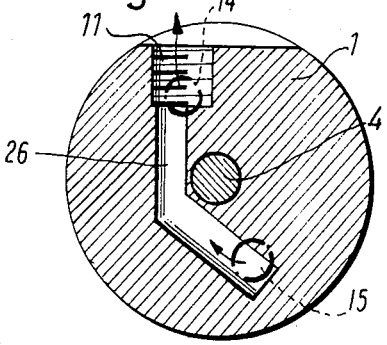
FIG. 5 is a sectional view illustrating the configuration of the return channel.
Figure 4:
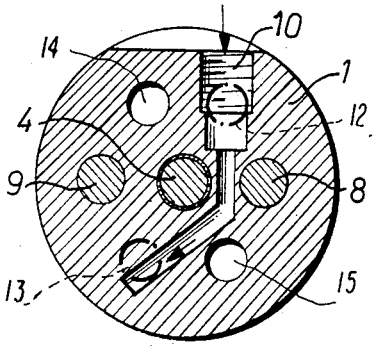
FIG. 4 is a sectional view illustrating the configuration of the feed channel.

FIGS. 4 and 5 illustrate more clearly how the channels connected to the inlet 10 and outlet 11 respectively are drawn in the mounting part 1 and branch to the ports 12–14 in the end surface of said mounting part. It will be seen herefrom that a pump, or motor, according to the invention need only include one inlet and one outlet, both of which are arranged radially in the mounting part 1, which in many connections simplifies the mounting and the positioning of said lines. In order to enable this, the inlet and the outlet 10 and 11 respectively are mutually displaced axially, so that the channels pass freely from each other, see FIG. 1.

FIG. 2 also shows that the cover 2 can be provided with a hole or port which can be closed by means, for example, of a screw-threaded plug 27. This hole, or port, is particularly intended for when the arrangement is used as a submersible pump and is operated at very high speeds, for example speeds in the region of 10–20,000 rpm. In this respect, if the level of liquid in the space in which the pump is immersed should fall beneath the main inlet port, the flow of oil through the hole in the cover 2 will be sufficient to properly lubricate the pump sothat it does not seize up. The hole, however, is too small to provide sufficient flow for the operation of the arrangement coupled to the pump, and hence an indication that the oil level is too low is given automatically.

As will be understood from the aforegoing, one very important advantage afforded by a pump, or motor, according to the present invention is that the pump, or motor, can be readily adapted to prevailing conditions, by exchanging solely the cover 2 with associated gears. This can have great practical significance when the pump and/or the motor are integrated in a construction, so that only the cover is accessible. This makes possible, for example, the construction of a universal drive unit for hand tools, where the same pump and motor can be used but the transmission ratio therebetween can be readily varied in dependence upon the tool for which the drive unit is to be used. For example, when coupling together a pump and a motor according to the invention, which have a given transmission ratio relative to one another, this ratio is inverted without requiring new components, by simply mutually changing the cover 2 of the respective pump and motor. All that is required when changing between right-hand and left-hand rotation is for the supply lines and return lines to be shifted.

The invention has been described in the aforegoing with reference to an arrangement including a sun wheel and two planet wheels. The principle of the invention is not, however, restricted to the number of wheels used. In the described embodiment, the shaft 3 has the form of a one-piece structure. As will be understood, the shaft may also comprise a number of shaft sections.

What is claimed is:

1. A fluid pump or motor, comprising:

(a) a housing including a mounting member (1) and a readily exchangeable cover member (2) sealingly joined to an end face of the mounting member, (b) a first shaft (4) rotatably journalled in the mounting member and extending outwardly from said end face, (c) two second shafts (8, 9) fixedly mounted in the mounting member and extending outwardly from said end face spaced from and parallel to the first shaft, (d) respective fluid inlet and fluid outlet channels (10, 11) defined in the mounting member and having openings (12–15) in said end face, (e) a sun gear (5) removably mounted on the outward extension of the first shaft and fixed thereto for rotation therewith, (f) two planet gears (6, 7) rotatably and removably journalled on the respective outward extensions of the second shafts and in mesh with the sun gear, (g) blind wells (16) defined in the cover member configured to closely accommodate the sun and planet gears and serving as a pressure chamber, and (h) blind bores (17–20) defined in the cover member, communicating with said blind wells, and positioned to correspond with said fluid inlet and outlet channel openings in said end face upon assembly of the housing, whereby one cover member and associated gears may be replaced by another, different cover member and different associated gears to thereby change the pump or motor capacity or fluid transmission ratio without dismantling, dismounting or otherwise disturbing the mounting member and fluid lines connected thereto, (i) wherein the mounting member is provided with an inlet and an outlet for hydraulic oil which each communicate with a respective channel, each of said channels is branched and forms two openings in said end face, and the cover member includes four blind bores which communicate with the wells therein.

2. A pump or motor according to claim 1, wherein the inlet and outlet for hydraulic oil are radially disposed.

3. A pump or motor according to claim 1, wherein axially innermost surfaces of the blind wells in the cover member are provided with coaxial recesses for accommodating ends of the first and second shafts extending beyond their respective gears.

4. A pump or motor according to claim 1, wherein the cover member has at least one hole closeable by a removable plug (27), said hole serving as an auxiliary lubricating hole when the pump is used as a submersible pump.

5. A pump or motor according to claim 1, wherein the mounting member has a channel (25) which connects the fluid outlet channel with a lead-through hole for the first shaft in said mounting means.

* * * * *